US005826715A

United States Patent [19]

Thompson

[11] Patent Number: 5,826,715

[45] Date of Patent: Oct. 27, 1998

[54] TIME-LOCKED CIGARETTE CASE

[76] Inventor: David Milton Thompson, 26 Finch Place, Hamilton, Ontario, Canada, L9A 5C3

[21] Appl. No.: 814,896

[22] Filed: Mar. 12, 1997

Related U.S. Application Data

[60] Provisional application No. 60/031,426, Nov. 21, 1996, and provisional application No. 60/020,208, Jun. 21, 1996, and provisional application No. 60/013,316, Mar. 13, 1996.

[51] Int. Cl.[6] ..... B65D 55/02

[52] U.S. Cl. ..... 206/261; 70/63; 206/1.5; 968/812

[58] Field of Search ..... 70/63, 269, 272, 70/273; 131/270; 206/1.5, 236, 242, 246, 249–256, 261–263, 265; 968/812, DIG. 1

[56] References Cited

U.S. PATENT DOCUMENTS

| | | | |
|---|---|---|---|
| 2,415,911 | 2/1947 | Rubane | 70/273 |
| 2,613,527 | 10/1952 | Harris | 70/273 |
| 3,030,795 | 4/1962 | Vogt | 206/265 |
| 3,363,439 | 1/1968 | Kende | 70/272 |
| 3,660,998 | 5/1972 | Ishijima | 70/269 |
| 4,615,681 | 10/1986 | Schwarz | 131/270 |

*Primary Examiner*—Jimmy G. Foster
*Attorney, Agent, or Firm*—Rogers & Scott

[57] ABSTRACT

A time-locked cigarette case has time-controlled locking mechanism which is manually adjustable by the user and also has a first latch rod which normally retains the case in a closed condition and a second latch rod which moves to retain the case in a closed condition if the first latch rod is jolted to an open position so as to prevent the case from being opened by jolting before the manually set time delay has expired.

3 Claims, 6 Drawing Sheets

TIME-LOCKED CIGARETTE CASE

Figure 2:
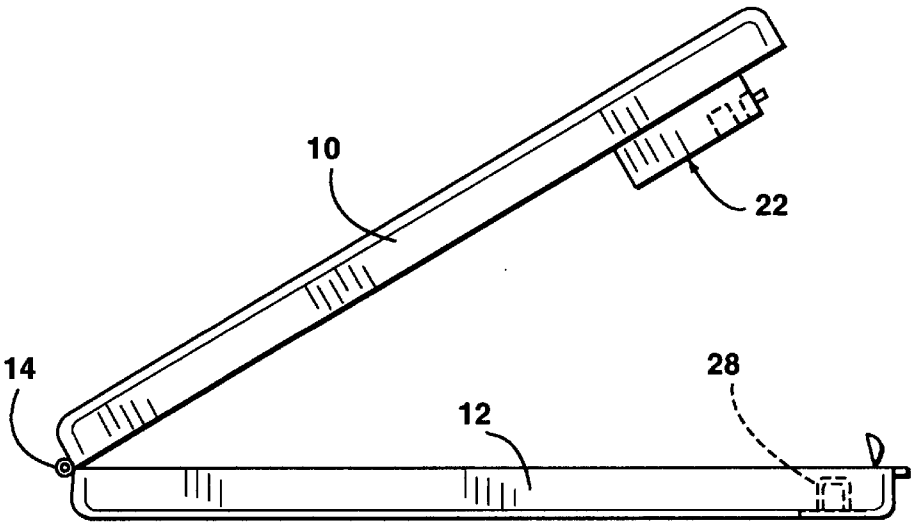

This application claims the benefit under 35 USC 119(e) of provisional applications 60/013,316 filed Mar. 13, 1996, 60/020,208 filed on Jun. 21, 1996, and 60/031,426 filed on Nov. 21, 1996.

This invention relates to time-locked cigarette cases.

It is well known that cigarette smokers have difficulty in reducing the number of cigarettes smoked in any given time, and there have been many proposals over the years which were intended to assist a smoker to reduce his or her smoking rate. Such proposals have included time-locked cigarette cases. However, previously proposed cigarette cases of this kind have for one reason or another not proved to be commercially successful.

It is therefore an object of the present invention to provide an improved time-locked cigarette case which is relatively simple in construction and which at the same time is relatively resistant to tampering, that is to say is resistant to being opened before a pre-set time after closing has elapsed.

According to the invention, a time-locked cigarette case has first and second body portions hingedly connected at one end thereof for movement about a transverse axis between open and closed positions, the first and second body portions forming a cigarette storing chamber when in the closed position, the first and second body portions having ends opposite to the one ends provided with time-controlled locking mechanism. The time-controlled mechanism includes transversely-movable first and second latch rods carried by the first body portion and a latch retainer carried by the second body portion for receiving the first or second latch rods to retain the body portions in a locked closed position.

The time-controlled locking mechanism also includes an electrical timing assembly carried by the first body portion, the electrical timing assembly including a battery replaceable from the exterior of the first body portion, a solenoid unit slidably mounted on the first body portion for transverse sliding movement between a normal position and jolt-induced position, a solenoid unit having a coil part, an armature part slidably moveable therein and a permanent magnet normally retaining the armature part in one position in the coil part. The locking mechanism also has a resilient stop normally urging the solenoid unit to the normal position. The first latch rod is carried by one of the coil and armature parts of the solenoid unit, and the second latch rod is carried by the other of the coil and armature parts of the solenoid unit. The electrical timing assembly also includes a manually adjustable time delay circuit powered by the battery and connected to the solenoid unit.

The first latch rod is moveable from an open position to a closed position, when the first and second body portions have been moved to the closed position from an open position, wherein the first latch rod is in engagement with the latch retainer and the permanent magnet retains the armature part in the one position in the coil part. The second latch rod is positioned to move into engagement with the latch retainer if a jolt is applied to the cigarette case, when in the closed condition, to cause the first latch rod to move out of engagement with the latch retainer. Such movement of the first latch rod causes sliding movement of the solenoid unit to the jolt-induced position with consequent movement of the second latch rod into engagement with the latch retainer, thereby preventing the cause from being opened.

The resilient stop subsequently returns the solenoid unit to the normal position, thereby releasing the second latch rod from the latch retainer and returning the first latch rod into engagement with the latch retainer.

The electrical timing assembly operates to move the armature part out of the coil part of the solenoid unit against the retaining force of the permanent magnet, upon expiry of the manually-adjusted time delay after closing of the case and movement of the first latch rod to the closed position, to move the first latch rod out of engagement with the latch retainer without movement of the second latch rod, whereby the case can be opened.

Thus, when closing the cigarette case, a smoker can pre-set the time delay which has to elapse before the cigarette case can be opened again. If a smoker tries to open the case before the pre-set time has elapsed by trying to jolt the first latch rod from the closed position to the open position, such movement of the first latch rod is accompanied by back-up movement of the second latch rod into engagement with the latch retainer, so that the cigarette case remains time-locked.

The electrical timing assembly may also include a capacitor connected to the solenoid unit and which becomes sufficiently charged, upon the expiry of the time delay, to cause an actuating current to pass through the solenoid coil part which is sufficient to cause the armature part to be moved out of the coil part against the retaining force of the permanent magnet and move the first latch rod out of engagement with the latch retainer without movement of the second latch rod, whereby the case can be opened.

The first latch rod may be carried by the armature part of the solenoid unit, with the second latch rod being carried by the coil part of the solenoid unit.

Figure 1:
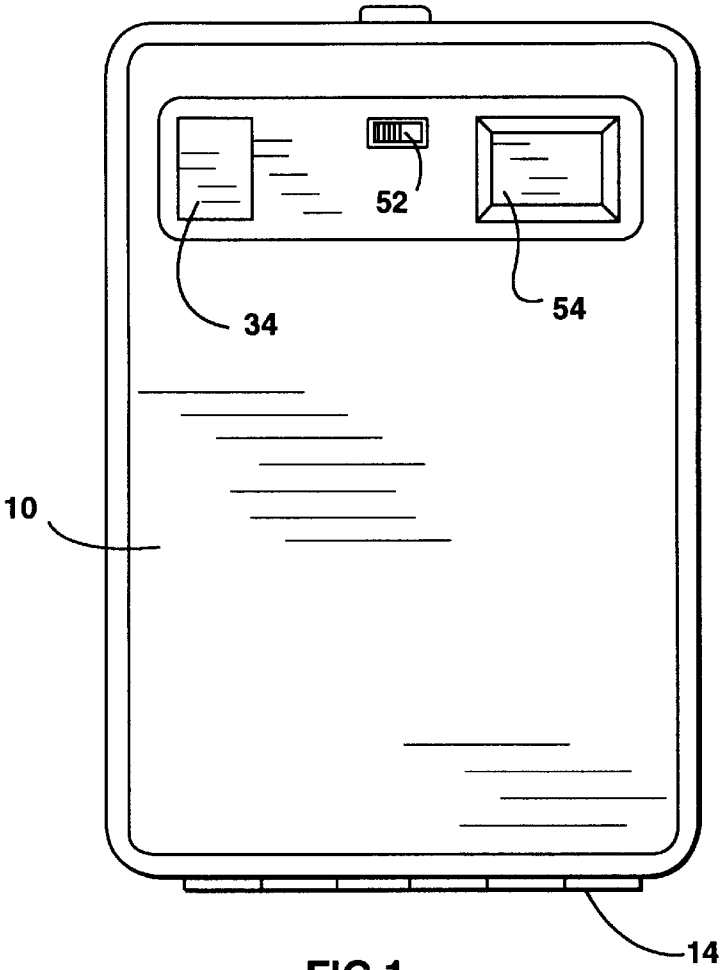
Figure 3:
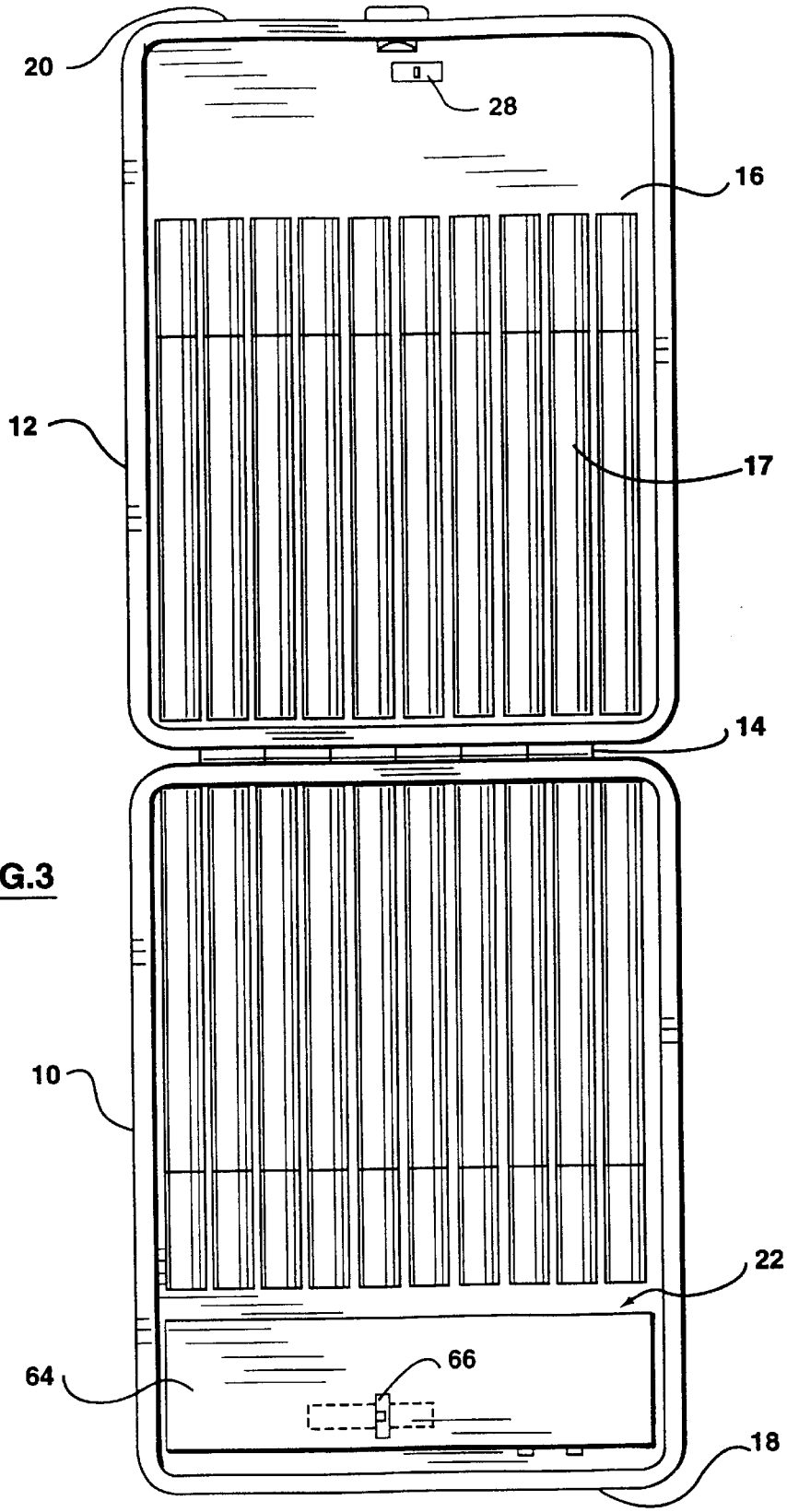

One embodiment of the invention will now be described, by way of example, with reference to the accompanying drawings, of which:

FIG. 1 is a front view of a time-locked cigarette case in the closed position, FIG. 2 is a side view of the cigarette case in a partly opened position, FIG. 3 is a plan view of the cigarette case in a fully open position.

Figure 4:
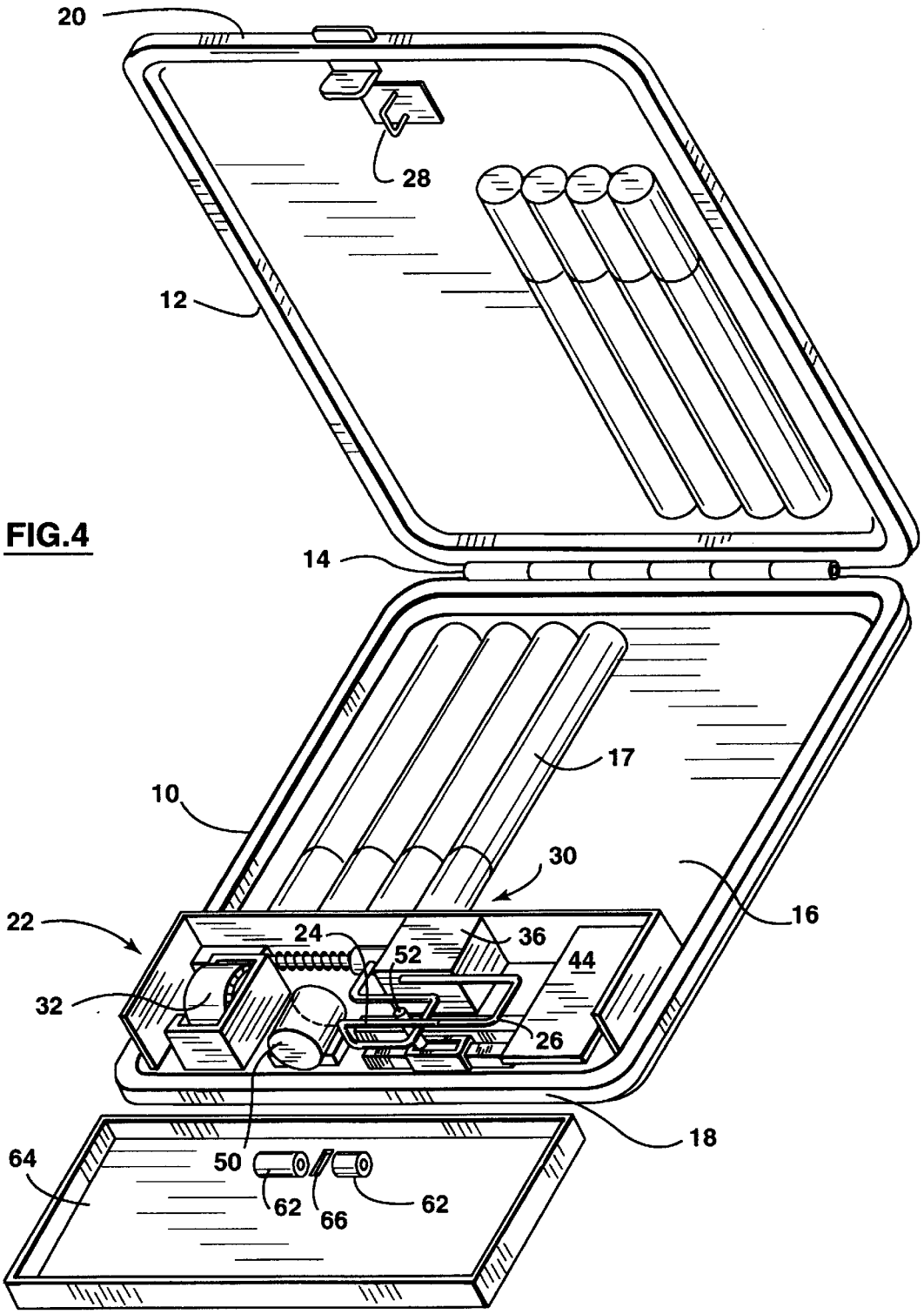
Figure 5:
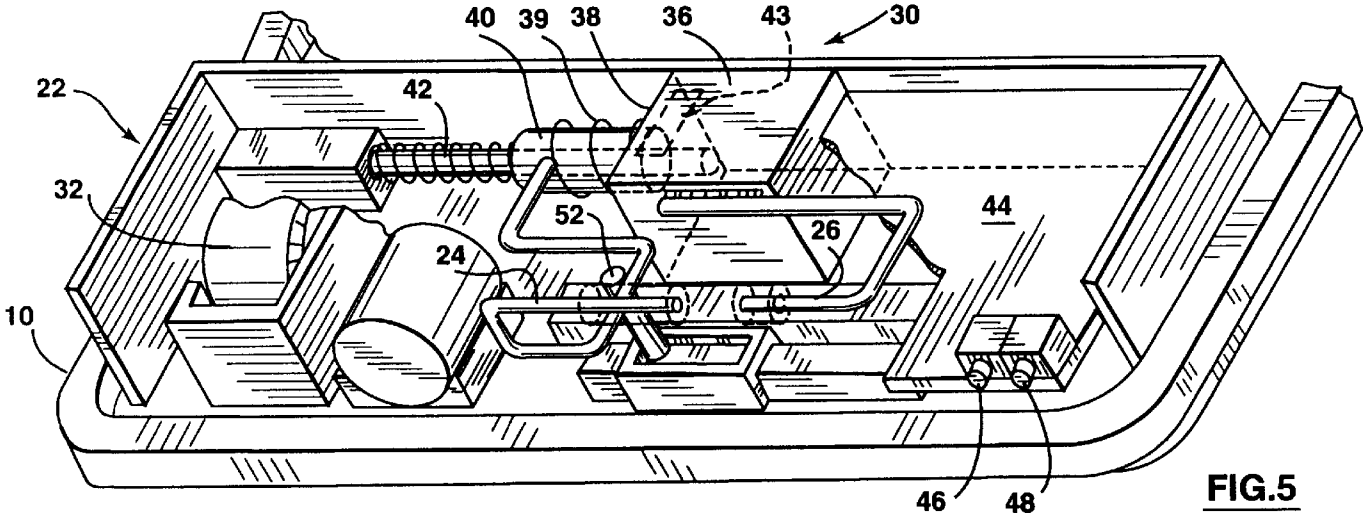
Figure 6:
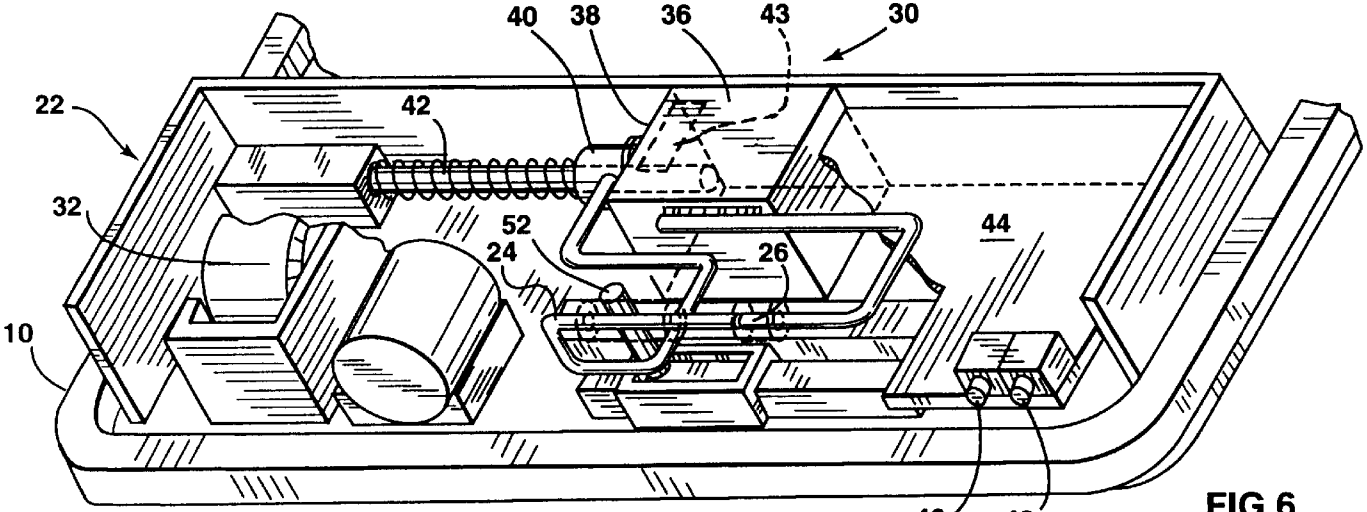
Figure 7:
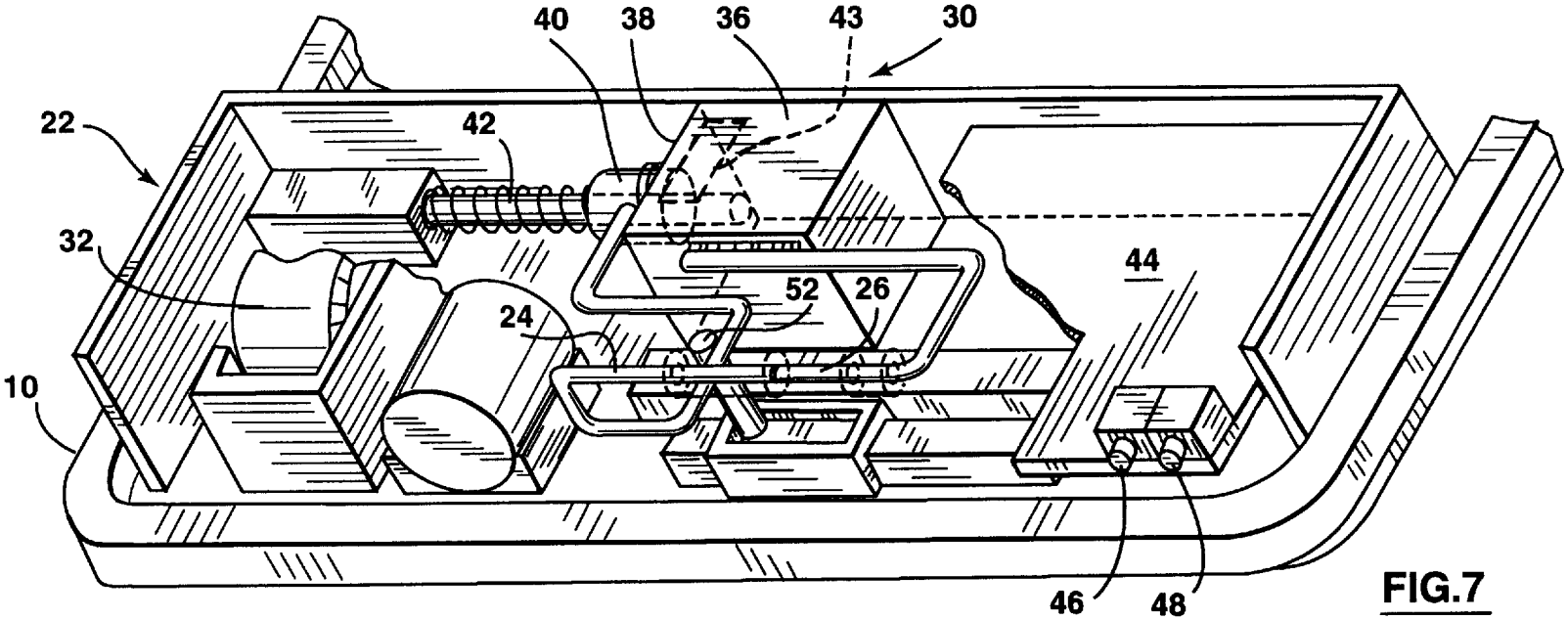
Figure 8:
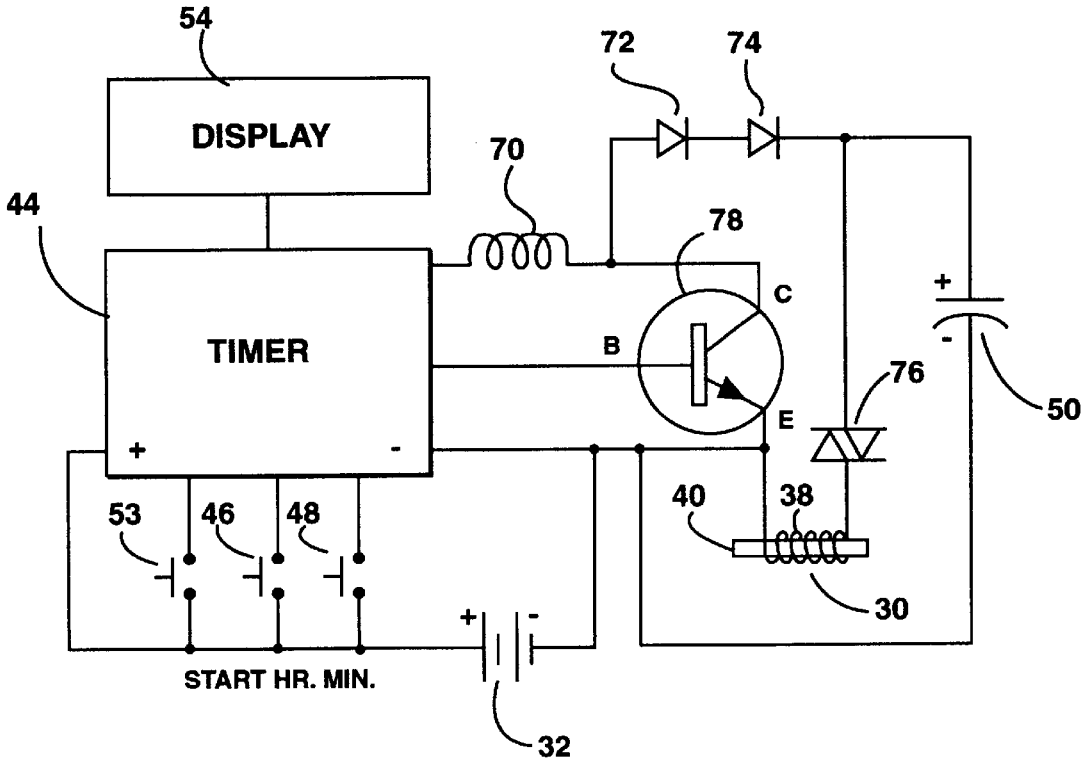

FIG. 4 is a perspective view of the cigarette case in a partly opened position with the cover of the time-locked mechanism removed, the mechanism being shown in the normal locked position, FIG. 5 is a perspective view on an enlarged scale of the time-controlled mechanism in an opened condition, FIG. 6 is a similar view showing the time-controlled mechanism in the normal closed condition as in FIG. 4, FIG. 7 is a similar view showing the time-controlled mechanism in the jolt-induced position, and FIG. 8 shows the manually adjustable time-delay circuit.

Referring to the drawings, a time-locked cigarette case has first and second body portions 10, 12 hingedly connected at one end by a hinge 14 for movement about a transverse axis between open and closed positions, the first and second body portions 10, 12 forming a cigarette storing chamber 16 for cigarettes 17 when in the closed position.

The first and second body portions 10, 12 have opposite ends 18, 20 provided with time-controlled locking mechanism 22 which includes transversely-extending first and second latch rods 24, 26 carried by the first body portion 10 and a latch retainer 28 carried by the second body portion 12 for receiving the first or second latch rods 24, 26 to retain the body portions 10, 12 in a closed position.

The time-controlled locking mechanism 22 also includes an electrical timing assembly 30 including a battery 32 replaceable from the exterior of the first body portion 10, access therefrom from the exterior being provided by a removable battery compartment cover 34. The electrical timing assembly 30 also includes a solenoid unit 36 slidably mounted on the first body portion 10 for transverse sliding movement between a normal position and a jolt-induced position. The solenoid unit 36 has a coil part 38, and armature part 40 slidably movable therein and a permanent magnet 43 normally retaining the armature part 40 in one position in the coil part 38. A resilient stop 42 urges the solenoid unit 36 to the normal position. The first latch rod 24 is carried by armature part 40, and the second latch rod 26 is carried by the coil part 38 of the solenoid 36.

The electrical timing assembly 30 also includes a manually-adjustable time delay circuit 44 (shown in detail in FIG. 8) powered by the battery 32 and connected to the solenoid unit 36. The time delay circuit 44 can be programmed to adjust the time delay by two buttons 46, 48. The first button 46 is operable to set the number of hours and the second button 48 is operable to set the number of minutes. The electrical timing assembly 30 also includes a capacitor 50 connected to the solenoid unit 36 which functions in a manner to be described later. The first body portion 10 also carries an externally operable slide switch 52, the function of which will also be described later.

Assuming that the smoker has just taken a cigarette from the open cigarette case, the smoker actuates the two buttons 46, 48 to adjust the time delay which must elapse before the cigarette case can be opened again after it has been closed. The time set will appear on an LCD display 54. The smoker then closes the case and moves the slide switch 52 which engages the first latch rod 24 to move the first latch rod 24 from the open position shown in FIG. 5 to the closed position shown in FIG. 6 in which the first latch rod 24 is engaged in the latch retainer 28. Such movement of the first latch rod 24 moves the armature part 40 in to the coil part 38 of the solenoid unit 36, the armature part 40 being retained in this position by the permanent magnet 43. The movement of the slide switch 52 also actuates the start button 53 to actuate the timing assembly 30 to begin the timing cycle.

If, before the time delay has expired, the smoker tries to open the cigarette case by jolting the first latch rod 24 out of engagement with the latch retainer 28, such movement of the first latch rod 24 causes sliding movement of the solenoid unit 26 to the jolt-induced position shown in FIG. 7, with consequent movement of the second latch rod 26 into engagement with the latch retainer 28, thereby preventing the case from being opened. The movement of the solenoid unit 36 to the jolt-induced position compresses the resilient stop 42, which subsequently returns the solenoid unit 36 to the normal position shown in FIG. 6, thereby releasing the second latch rod 26 from the latch retainer 28 and returning the first latch rod 24 into engagement with the latch retainer 28.

On expiry of the time delay, the timing assembly 30 operates to cause the battery 32 to charge the capacitor 50 which subsequently discharges through the coil part 38 of the solenoid circuit 36. The passage of the discharge current through the coil part 38 produces a magnetic field which neutralizes the retaining force of the permanent magnet 42 and permits the spring 39 in the solenoid unit 36 to move the armature part 40 out of the coil part 36. Such movement of the armature part 40 cause the first latch rod 24 to be moved out of engagement with the latch retainer 24 as shown in FIG. 5, thereby enabling the case to be opened.

It should be pointed out that the first and second latch rods, 24, 26 travel in cylindrical guides 60, 62 secured to a timing circuit cover 64 which is shown in a removed position in FIG. 4 and is omitted from FIGS. 5 to 7. When in the closed condition, the latch retainer 28 passes through an aperture 66 in the cover 64 and becomes positioned between the guides 60, 62 for engagement by the first or second latch rods, 24, 26.

As shown in FIG. 8, the timing circuit 44 is connected to the positive side of capacitor 50 (which is a polarized capacitor) through a choke 70 and diodes 72, 74. The negative side of capacitor 50 is connected to the negative side of battery 32 and the timing circuit 44. The positive side of capacitor 50 is also connected through a diac 76 to one end of the solenoid coil part 38, the other end of which is connected to the negative side of the battery 32 and the timer 44 and also to the emitter of a transistor 78. The collector of the transistor 78 is connected to a position between the choke 70 and the diode 72, and the base of the transistor 78 is connected to the timing circuit 44.

The advantages of the invention will be readily apparent to a person skilled in the art from the foregoing description of a preferred embodiment. Further, the time delay cannot be circumvented by removing the battery 32, because the latch rod 24 will be held in position by the permanent magnet 42. The timing circuit 44 may be arranged so that removal and replacement of the battery 34 causes the timer 44 to reset to a predetermined time delay, such as one hour. Alternatively, the timer 44 may be provided with a memory which enables the original timing cycle to be continued when the battery 32 has been replaced.

Other embodiments will be readily apparent to a person skilled in the art, the scope of the invention being defined in the appended claims.

I claim:

1. A time-locked cigarette case having:

first and second body portions hingedly connected at one end thereof for movement about a transverse axis between open and closed positions, said first and second body portions forming a cigarette storing chamber when in the closed position, said first and second body portions having ends opposite to said one ends provided with time-controlled locking mechanism, said time-controlled locking mechanism including transversely-movable first and second latch rods carried by the first body portion and a latch retainer carried by the second body portion for receiving the first or second latch rods to retain the body portions in a locked closed position, said time-controlled locking mechanism also including an electrical timing assembly carried by the first body portion, said electrical timing assembly including a battery replaceable from the exterior of the first body portion, a solenoid unit slidably mounted on the first body portion for transverse sliding movement between a normal position and a jolt-induced position, said solenoid unit having a coil part, an armature part slidably moveable therein and a permanent magnet normally retaining the armature part in one position in the coil part, said locking mechanism also having a resilient stop normally urging the solenoid unit to the normal position, the first latch rod being carried by one of the coil and armature parts of the solenoid unit, and the second latch rod being carried by the other of the coil and armature parts of the solenoid unit, said electrical timing assembly also including a manually adjustable time delay circuit powered by the battery and connected to the solenoid unit, said first latch rod being moveable from an open position to a closed position, when the first and second body portions have been moved to the closed position from an open position, wherein the first latch rod is in engagement with the latch retainer and the permanent magnet retains the armature part in said one position in the coil part, said second latch rod being positioned to move into engagement with the latch retainer, if a jolt is applied to the cigarette case when in the closed condition to cause the first latch rod to move out of engagement with the latch retainer, with said movement of the first lateral rod causing sliding movement of the solenoid unit to the jolt-induced position with consequent movement of the second latch rod into engagement with the latch retainer, thereby preventing the case from being opened, said resilient stop subsequently returning the solenoid unit to the normal position, thereby releasing the second latch rod from the latch retainer and returning the first latch rod into engagement with the latch retainer, and the electrical timing assembly operating to move the armature part out of the coil part of the solenoid unit against the retaining force of the permanent magnet, upon expiry of the manually-adjusted time delay after closing of the case and movement of the first latch rod to the closed position, to move the first latch rod out of engagement with the latch retainer without movement of the second latch rod, whereby the case can be opened.

2. A time-locked cigarette case according to claim 1 wherein the electrical timing assembly also includes a capacitor connected to the solenoid unit and which becomes sufficiently charged, upon said expiry of the time delay, to cause an actuating current to pass through the solenoid coil part which is sufficient to cause the armature part to be moved out of the coil part against the retaining force of the permanent magnet and move the first latch rod out of engagement with the lateral retainer without movement of the second latch rod, whereby the case can be opened.

3. A time-locked cigarette case according to claim 1 wherein the first latch rod is carried by the armature part of the solenoid unit and the second latch rod is carried by the coil part of the solenoid unit.

* * * * *